US010619989B2

(12) United States Patent
Ohlson

(10) Patent No.: US 10,619,989 B2
(45) Date of Patent: Apr. 14, 2020

(54) LOCKING ARRANGEMENT FOR A BLAST-RESISTANT CONTAINER

(71) Applicant: DYNASAFE PROTECTION SYSTEMS AB, Karlskoga (SE)

(72) Inventor: Fredrik Ohlson, Torslanda (SE)

(73) Assignee: DYNASAFE PROTECTION SYSTEMS AB, Karlskoga (SE)

( * ) Notice: Subject to any disclaimer, the term of this patent is extended or adjusted under 35 U.S.C. 154(b) by 0 days.

(21) Appl. No.: 16/339,224

(22) PCT Filed: Oct. 10, 2017

(86) PCT No.: PCT/EP2017/075853
§ 371 (c)(1),
(2) Date: Apr. 3, 2019

(87) PCT Pub. No.: WO2018/073057
PCT Pub. Date: Apr. 26, 2018

(65) Prior Publication Data

US 2020/0041244 A1 Feb. 6, 2020

(30) Foreign Application Priority Data

Oct. 21, 2016 (EP) ..... 16195128

(51) Int. Cl.
*F42D 5/045* (2006.01)
*F42B 33/06* (2006.01)
*F42B 39/14* (2006.01)

(52) U.S. Cl.
CPC ..... *F42D 5/045* (2013.01); *F42B 33/06* (2013.01); *F42B 39/14* (2013.01)

(58) Field of Classification Search
None
See application file for complete search history.

(56) References Cited

U.S. PATENT DOCUMENTS

| | | | | |
|---|---|---|---|---|
| 1,144,683 | A | 6/1915 | Barder | |
| 2005/0115384 | A1* | 6/2005 | Reynolds | B65F 1/02 86/50 |
| 2008/0314903 | A1* | 12/2008 | Ohlson | F42D 5/045 220/239 |
| 2009/0044690 | A1 | 2/2009 | King | |
| 2012/0085222 | A1* | 4/2012 | Travis | F42B 15/36 89/1.14 |
| 2014/0224101 | A1* | 8/2014 | Benson | F42B 1/02 86/50 |

FOREIGN PATENT DOCUMENTS

| | | |
|---|---|---|
| WO | 2006041351 A1 | 4/2006 |
| WO | 2012082002 A1 | 6/2012 |
| WO | 2016081977 A1 | 6/2016 |

OTHER PUBLICATIONS

PCT International Search Report and Written Opinion dated Dec. 20, 2017 for International Application No. PCT/EP2017/075853, 11 pages.

* cited by examiner

*Primary Examiner* — Stephen Johnson
(74) *Attorney, Agent, or Firm* — RMCK Law Group, PLC

(57) ABSTRACT

The present invention relates to a blast-resistant container, and particularly to a locking arrangement arranged to provide a simplified connection for interlocking a first and a second vessel portion forming part of the container.

15 Claims, 4 Drawing Sheets

LOCKING ARRANGEMENT FOR A BLAST-RESISTANT CONTAINER

CROSS-REFERENCE TO RELATED APPLICATIONS

This application is a 371 U.S. National Stage of International Application No. PCT/EP2017/075853, filed Oct. 10, 2017, which claims priority to European Patent Application No. 16195128.0, filed Oct. 21, 2016. The disclosures of each of the above applications are incorporated herein by reference in their entirety.

TECHNICAL FIELD

The present invention relates to a blast-resistant container, and particularly to a locking arrangement arranged to provide a simplified connection for interlocking a first and a second vessel portion forming part of the container.

BACKGROUND OF THE INVENTION

A destruction system may be used for transporting and destroying explosive objects such as e.g. ammunition, propellants or explosives, including for example old unusable or unwanted ammunition. Such a system must be robust in order to withstand the high loads of possible detonating explosives.

An example of such a detonation-proof container for the transport and storage of detonation-dangerous material is disclosed in EP1809929 where munitions are loaded in a container by opening and closing a locking ring that is disposed between two parts forming the container. Loading of munitions into the destruction chamber is an important part of the destruction process and it is thus desirable to enable a user-friendly and safe way to do it. Even though the above mentioned prior art shows very useful solutions for connecting/disconnecting the parts of the container, it would still be desirable to even further optimize such an arrangement, for example to be able to reduce an overall manufacturing cost.

SUMMARY OF THE INVENTION

In view of the above-mentioned need, a general object of the present invention is to provide an improved blast-resistant which at least to some extent provide further improvements in relation to prior art. In addition, it is also desirable to simplify the process of manufacturing of such a blast-resistant, saving cost in manufacturing (including machining and manual labor) and assembly of the blast-resistant container. It is desirable that the blast-resistant container is detonation-proof, preferably gas-tight, and useful for storage and transport of detonation-dangerous or suspected detonation-dangerous material.

Thus, in according to an aspect of the invention there is provided a blast-resistant container, comprising a first open vessel portion having a first circular rim section having a first outer diameter, a second open vessel portion having a second circular rim section having a second outer diameter, and a locking arrangement comprising a ring shaped member having a circular inner circumference, the locking arrangement configured for interconnecting the first and the second open vessel portion, wherein an inner diameter of the ring shaped member is greater than the first and the second outer diameter of the first and the second open vessel portion, respectively, wherein sets of first axially parallel connection members having a first length are arranged to an outside surface of the first circular rim section, the sets of first axially parallel connection members being spaced apart with a first distance in a circumferential direction, sets of second axially parallel connection members having a second length are arranged to an outside surface of the second circular rim section, the sets of second axially parallel connection members being spaced apart with a second distance in a circumferential direction, an inner surface of the ring shaped member comprises first and second axially separated locking sections, the first locking section comprises spaced apart sets of axially parallel connection members matching the sets of first axially parallel connection members arranged at the outside surface of the first circular rim, and the second locking section comprises spaced apart sets of axially parallel connection members matching the sets of second axially parallel connection members arranged at the outside surface of the second circular rim.

By means of the present disclosure, there is provided a novel, alternative, approach to interconnecting vessel portions for forming a closed explosion resistant container, greatly simplifying and reducing the cost for manufacturing of the overall blast-resisting container. In comparison to the previously known approach as is shown EP1809929, where the locking ring has a multi-toothed double-sided bayonet coupling manufactured through a complicated milling/machining process, the locking arrangement according to the present disclosure is formed by providing or arranging a sets of axially parallel connection members. That is, rather than having to resort to a complex machining process in a manner as is necessary for achieving the double-sided bayonet coupling as is shown EP1809929, the sets of (curved) connection members may be manufactured separate from the ring shaped member of the locking arrangement, i.e. as different pieces of connected materials. As an alternative, the ring shaped member and the sets of connection members arranged at the inner surface of the ring shaped member may also be manufactured from a single piece of material, however in a milling/machining process being much less complicated as compared to the manufacturing of the mentioned double-sided bayonet coupling In accordance to the invention, the inner surface of the ring shaped member is defined as comprising a first and a second axially separated locking section. The first locking section is essentially defined as "half" of the inner surface of the ring shaped member, and the second locking section is defined as the second half of the inner surface of the ring shaped member. It is of course possible to divide the inner surface of the ring shaped member slightly different depending on the possible implementation.

Each of the first and the second locking section is provided with sets of spaced apart axially parallel connection members. In a corresponding manner, the outside surfaces of the rims of the two container parts, i.e. the first and the second open vessel portions, are provided with matching sets of spaced apart axially parallel connection members.

When applying the locking arrangement for interconnecting the first open vessel portion to the second open vessel portion, the sets of connection members at the first locking section are aligned with spaces defined between the sets of first connection members at the rim of the first open vessel portion. Once aligned in such a manner, the locking arrangement may be axially moved towards the first vessel portion. As is understood, the spaces (distance/length) between the sets of first connection members at the first vessel portion is at least large enough such that the sets of connection members at the first locking section are allowed to "enter"

(slide) between the sets of first connection members at the rim of the first open vessel portion. Accordingly, a length of the sets of connection members at the first locking section are selected to match the spaces between the sets of first connection members at the first vessel portion.

In a corresponding manner, the sets of axially parallel connection members at the second locking section are inserted within the spaces defined between the sets of second axially parallel connection members arranged at the outside surface of the second circular rim section. Accordingly, also a length of the sets of connection members at the second locking section are selected to match the spaces between the sets of second connection members at the second vessel portion.

Once the first and the second open vessel portions have been moved towards each other in the manner as described above, such that the first locking section is positioned "outside of" the outside surface of the first circular rim section and the second locking section is positioned outside of the outside surface of the second circular rim section, it will then be possible to rotate the locking arrangement to lock the first and the second open vessel portions together.

Specifically, as positioning of e.g. the sets of first axially parallel connection members and the sets of axially parallel connection members at the first locking section is such that an essential "threading" function may be achieved, where in essence one connection member at the rim will be positioned between two connection members at the locking section. In comparison to a normal threading of a "nut and bolt", the threading according to the invention will not necessarily provide a "screw function" for moving first and the second open vessel portions. Rather, the connection members may be arranged essentially in parallel with the end portion of the vessel portion/ring shaped member. Accordingly, the connection members of the vessel portion vs. the ring shaped member will be arranged in parallel to each other also when rotated together.

In a preferred embodiment of the present disclosure, the connection members at the first locking section/first rim are positioned circumferentially differently as compared to the connection members at the second locking section/second rim. For example, the first distance may be selected to be greater than the second distance, and the first length may be selected to be greater than the second length. In essence, in such an embodiment this would mean that the spaces between the sets of connection members at the first rim would be greater than the spaces between the sets of connection members at the second rim.

Preferably, the outside diameter of the first open vessel portion essentially corresponds to the outside diameter of the second open vessel portion. Accordingly, the inner diameter of the ring shaped member may in such a preferred embodiment be the same for both the first and the second locking section. It should however be understood that such an implementation is not necessary for the function performed by means of the present disclosure. Thus, the first outer diameter may, in some embodiments, be selected to be different to the second outer diameter.

As indicated above, the first open vessel portion is locked to the second open vessel portion by rotating the locking arrangement a first predetermined amount (degree) in a first direction. As the length of the connection members may be selected to be different for the first and the second vessel portion, this will also allow for the possibility of "keeping" the first vessel portion locked (or secured in an axial direction) to the locking arrangement if the locking arrangement is rotated a further second amount in the first direction. That is, in case the first length for example is selected to be double the second length, this would mean that the first predetermined amount and the second predetermined amount may be selected to be similar (essentially the same).

As this point it will be possible to separate the second vessel portion from the locking arrangement, making the "inside" of the blast-resisting contained accessible, for example for loading of munitions. At this point, once the second vessel portion is disconnected from the locking arrangement, it may be possible to again rotate the locking arrangement a further third amount in the first direction, where also the third amount may be selected to be similar to the first and the second predetermined amount, such that the locking arrangement also may be separated from the first vessel portion.

In accordance to the present disclosure, the connection members may be manufactured separate from e.g. the ring shaped member (as well as from the first/second vessel portion) and then arranged to the ring shaped member. The connection members, the ring shaped members as well as the first/second vessel portions are preferably manufactured from a metal material, such as for example steel. Accordingly, the connection members may for example be welded to the ring shaped member, a process that will be less complicated and costly when compared to the prior-art approach of milling/machining. In a preferred embodiment, the first and the second open vessel portion is constructed from a sheet metal element having a thickness of at least 20 mm. Furthermore, each of the first and the second open vessel portion preferably has a curved inner surface.

In addition to the above, it is preferred to select and match the diameters, distances, lengths, etc. in such a manner such that the container may be gas-tight once in a closed state, for the storage and transportation of detonation-dangerous material. In matching the diameters, distances, lengths, etc. in the manner as discussed above, it will be possible to allow the blast-resistant contained to be used for the detonation of dangerous material inside the same and to withstand high detonation pressure and splintering that might have been caused in the detonation. For achieving a gas tight blast-resistant container it may further be necessary to include e.g. groves, etc. with either of the rim sections or the locking arrangement for allowing the installation of e.g. a high-pressure sealing hose for inert gas. Once inflated, the high-pressure sealing hose will adapt the blast-resistant container to be gas tight.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
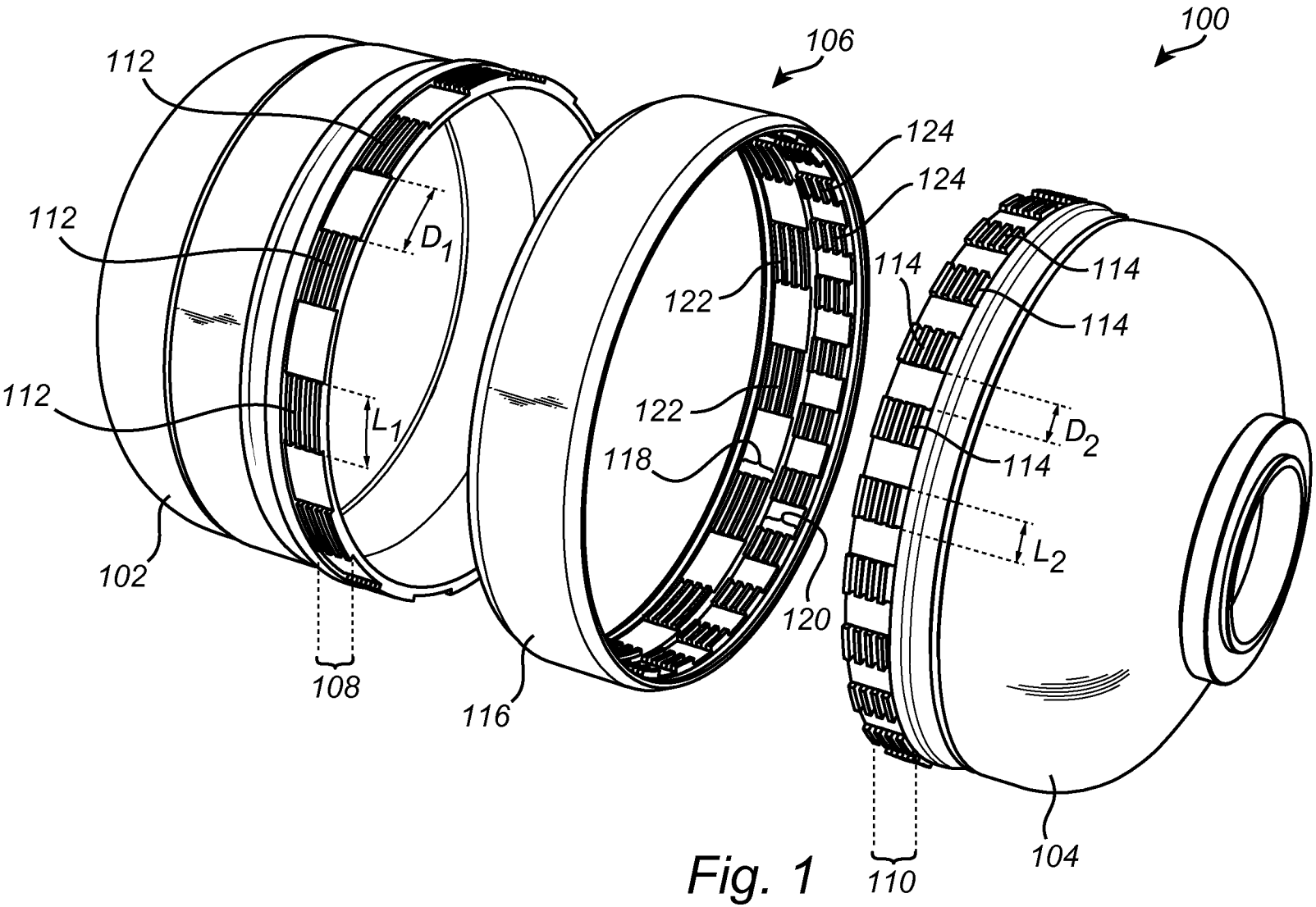
FIG. 1 conceptually illustrates a perspective view of a blast-resistant container according to a currently preferred embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings, where FIGS. 1-3 in conjunction depict a conceptual illustration of a blast-resistant container 100 and the operation of such a blast-resistant container 100 in accordance to a currently preferred embodiment of the invention. The blast-resistant container 100 may be arranged onto e.g. a vessel (not shown), allowing the blast-resistant container 100 to be used for transportation of suspected detonation-dangerous material.

In FIG. 1, the blast-resistant container 100 is illustrated to comprise a first 102 and a second 104 open vessel portion. The blast-resistant container 100 further comprises a locking arrangement 106 for interconnecting the first 102 to the second 104 open vessel portion.

The first open vessel portion 102 in turn comprises a first circular rim section 108, and the second open vessel portion 104 comprises a corresponding second circular rim section 110. At an outside surface of the first circular rim section 108 there are arranged, preferably by welding or alternatively by a milling/machining process, sets of first axially parallel connection members 112 having a first length L1. In a corresponding manner, also at an outside surface of the second circular rim section 110 there are arranged, again preferably by welding or alternatively by a milling/machining process, sets of second axially parallel connection members 114 having a second length L2. In the illustrated embodiment, the first length L1 is essentially twice the second length L2. The connection members 112, 114 are curved to match an outside curvature of the essentially circular first 102 and second 104 open vessel portions.

The sets of first axially parallel connection members 112 are spaced apart with a first distance D1, whereas the sets of second axially parallel connection members 114 are spaced apart with a second distance D2. The first length L1 is preferably at least slightly less than the first distance D1 and the second length L2 is preferably at least slightly less than the second distance D2 as will be further elaborated below.

The locking arrangement 106 is formed from a ring shaped member 116 having an inner diameter being greater than the outer diameters of the first 102 and the second 104 vessel portions. An inside surface of the ring shape member 116 is defined to comprise a first 116 and a second 118 locking section. At the first locking section 116, there are arranged sets of axially parallel connection members 120 matching the sets of first axially parallel connection members 112 arranged at the outside surface of the first circular rim 108. In a corresponding manner, at the second locking section 118 there are arranged sets of axially parallel connection members 122 matching the sets of second axially parallel connection members 114 arranged at the outside surface of the second circular rim 110. In a corresponding manner as discussed above, the connection members 120 and 122 are adapted to have a curvature matching the curved inside surface of the ring shaped member 116 and may be welded to the ring shaped member 116.

Furthermore, a length and a spacing/distance between the sets of connection members 120 and 122 is selected such that the locking arrangement 106 may be arranged onto the outside of the rim sections 108, 110, respectively, as will be further discussed below.

Figure 2A:
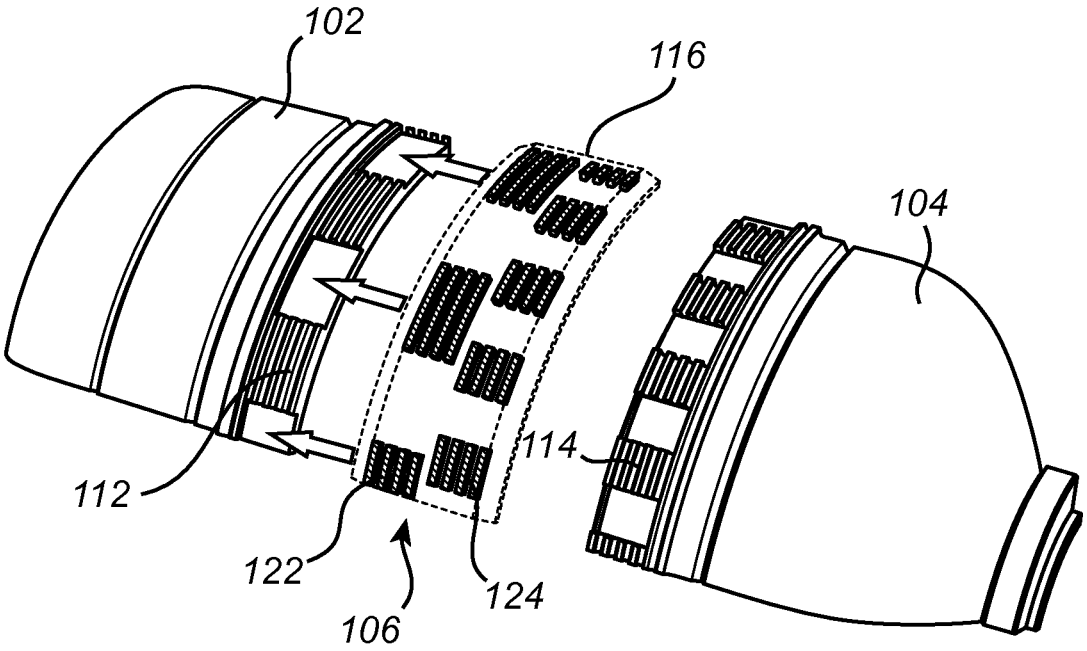
FIG. 2A-2C shows detailed views of a locking arrangement provided in relation to the inventive container for arranging the blast-resistant container in a closed state.

In FIG. 2A, the blast-resisting container 100 is illustrated in an unlocked and separated state. It should be understood that the locking arrangement 106 is shown in cross section, with the ring shaped member 116 marked with dotted lines. The connection members 120, 122 will thus be arranged on "an inside of" the ring shaped member 116. Specifically, connection members at the locking arrangement 106, the first 102 and the second 104 vessel portions are shown to be aligned such that the locking arrangement 106 may be arranged onto the outside of the rim sections 108, 110, respectively. As is indicated, the connection members 122 may be "inserted between" (i.e. in the spaced between) the connection members 112.

Figure 2B:
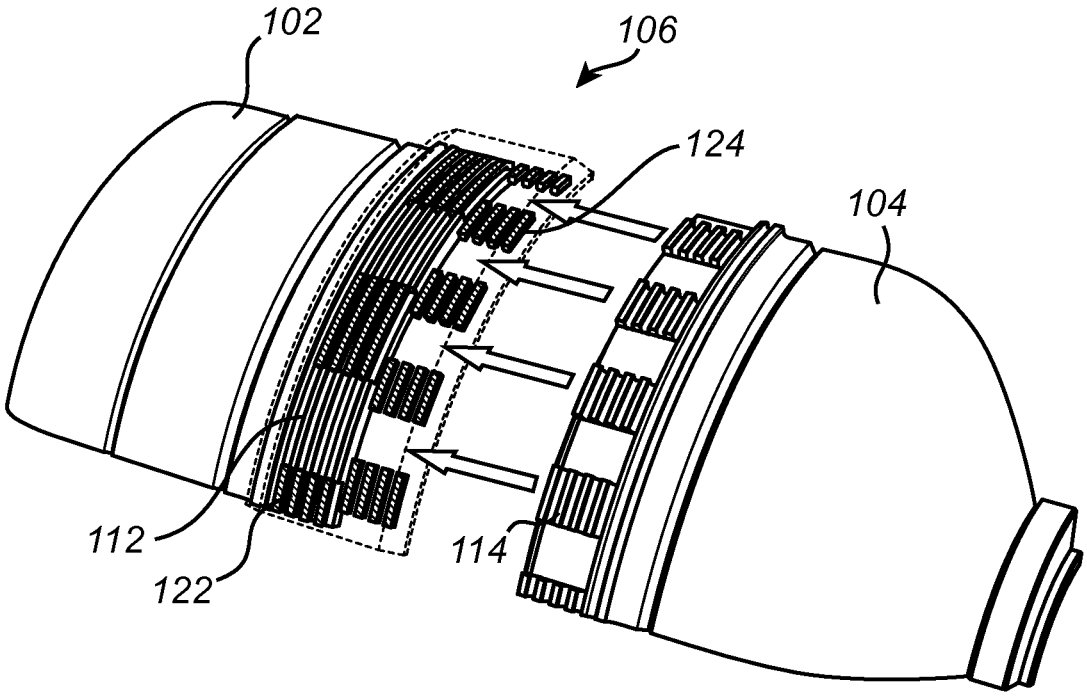
Figure 2C:
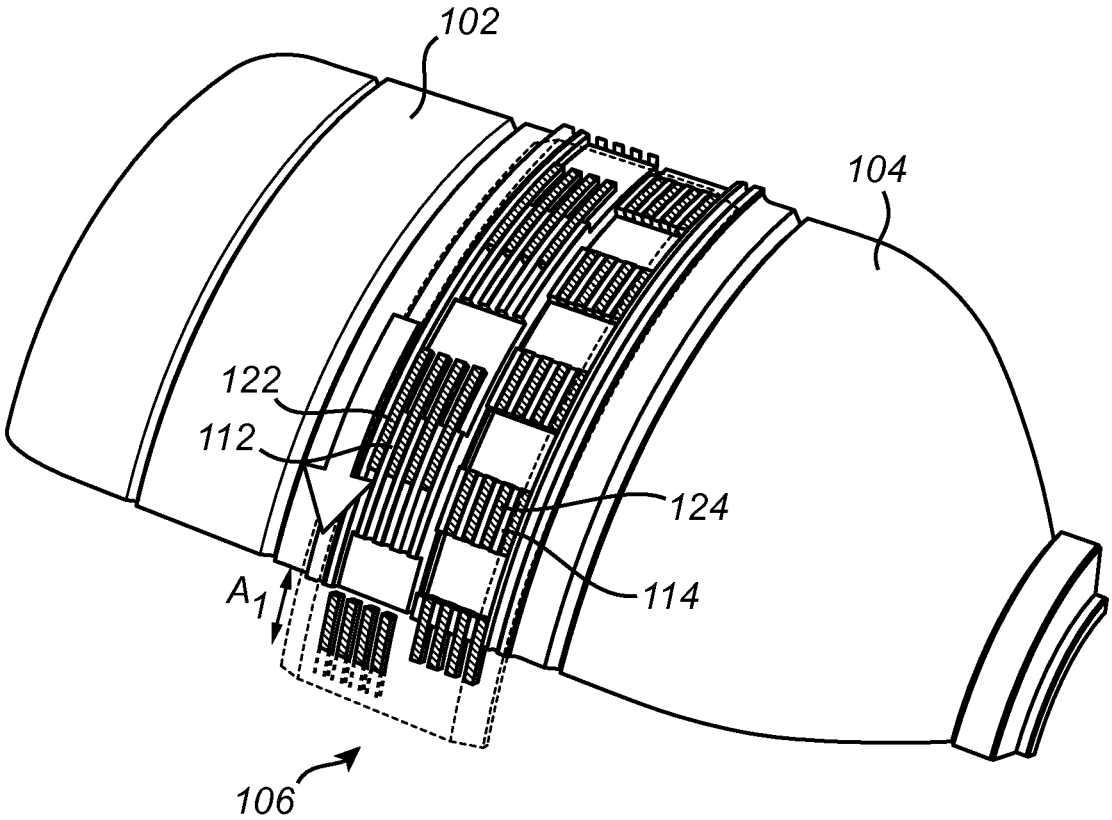

In FIG. 2B, possibly, once the connection members 122 have been inserted between the connection members 112, the connection members 114 are to be inserted between the connection members 124. At this stage, as is further shown in FIG. 2C, the locking arrangement 106 is rotated a first amount (degree) A1, whereby the connection members 112 will "thread" with the connection members 122, and the connection members 114 will thread with the connection members 124. In the illustration, the rotation the first amount A1 will make the connection members 112 to partly thread/align with the connection members 122 and connection members 114 will fully thread/align with the connection members 124. At this stage, as shown in FIG. 2C, the blast-resisting container 100 is illustrated in a locked and connected state.

Figure 3A:
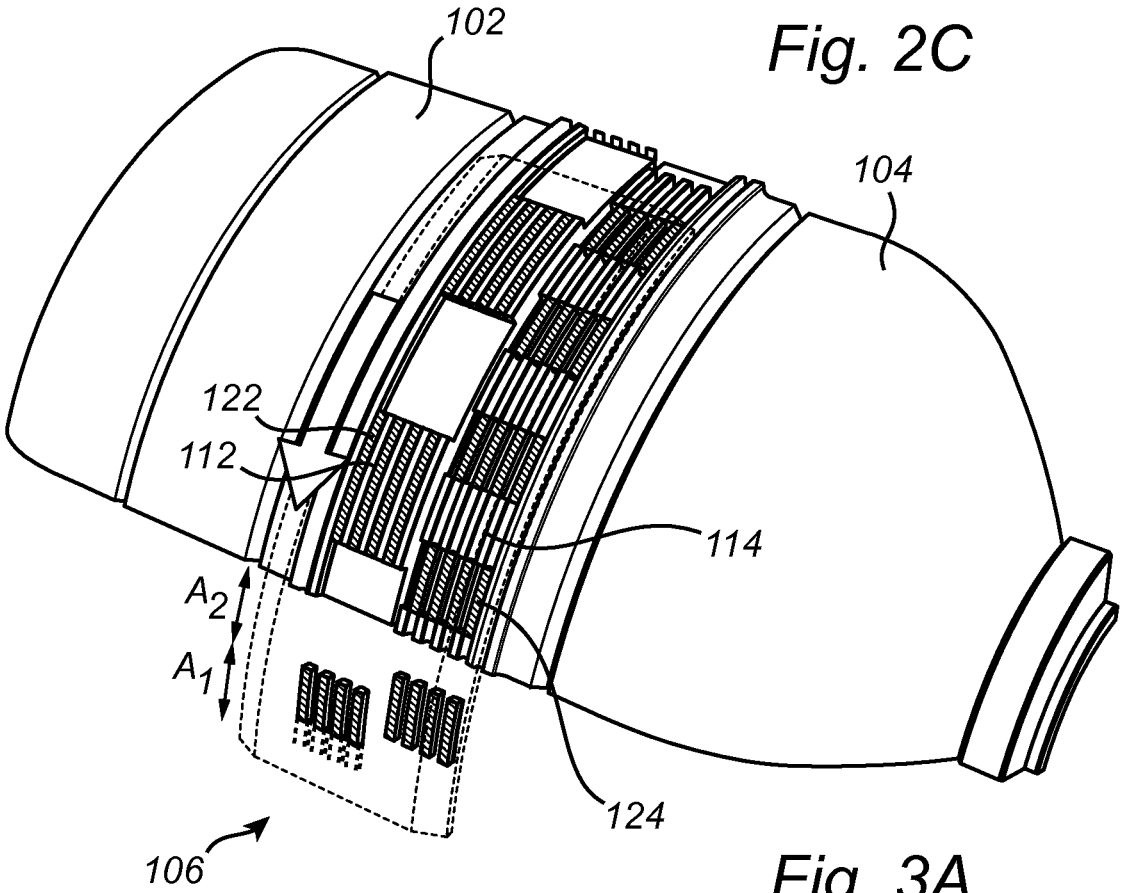
FIG. 3A-3B shows detailed views of a locking arrangement provided in relation to the inventive container for arranging the blast-resistant container in an open state.
Figure 3B:
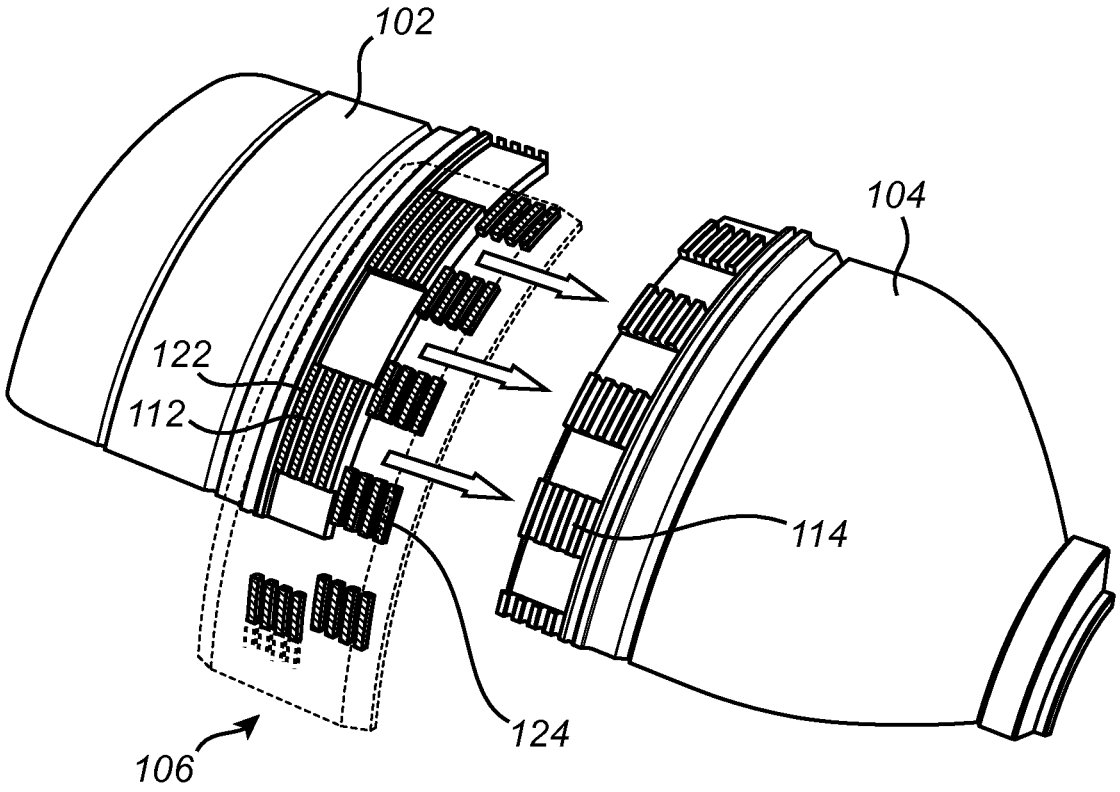

It will of course be needed to be able open up the blast-resisting container 100, for example for removing the suspected detonation-dangerous material. This is achieved by rotating the locking arrangement 106 a further second predetermined amount (degree) A2, as is shown in FIG. 3A. Specifically, at this point the connection members 112 will fully thread/align with the connection members 122 will align with the spaced between the connection members 114. Accordingly, and as is shown in FIG. 3B, the second vessel portion 104 may be separated from the locking arrangement 106. At this stage, as shown in FIG. 3B, the blast-resisting container 100 is illustrated in an unlocked state where the second vessel portion 106 is separated from the locking arrangement 106, at the same time as the locking arrangement is locked to the first vessel portion 102.

By further rotating the locking arrangement a third amount (degree), it may be possible to also separate the locking arrangement 106 from the first vessel portion 102. It should be understood that it may be desirable to include e.g. groves, etc. with either of the rim sections 108, 110 or the locking arrangement 106 for allowing the installation of e.g. a high-pressure sealing hose for inert gas. Once inflated, the high-pressure sealing hose will adapt the blast-resistant container 100 to be gas tight.

In summary, the present invention relates to a blast-resistant container, comprising a first open vessel portion having a first circular rim section having a first outer diameter, a second open vessel portion having a second circular rim section having a second outer diameter, and a locking arrangement comprising a ring shaped member having a circular inner circumference, the locking arrangement configured for interconnecting the first and the second open vessel portion, wherein an inner diameter of the ring shaped member is greater than the first and the second outer diameter of the first and the second open vessel portion, respectively, wherein sets of first axially parallel connection members having a first length are arranged to an outside surface of the first circular rim section, the sets of first axially parallel connection members being spaced apart with a first distance in a circumferential direction, sets of second axially parallel connection members having a second length are arranged to an outside surface of the second circular rim section, the sets of second axially parallel connection members being spaced apart with a second distance in a circumferential direction, an inner surface of the ring shaped member comprises first and second axially separated locking sections, the first locking section comprises spaced apart sets of axially parallel connection members matching the sets of first axially parallel connection members arranged at the outside surface of the first circular rim, and the second locking section comprises spaced apart sets of axially parallel connection members matching the sets of second axially parallel connection members arranged at the outside surface of the second circular rim.

In accordance with the present invention, there is provided an explosion resistant container that may be manufactured at a lower cost as compared to prior-art arrangements, due to the novel approach of affixing connection members to the locking arrangement as well as the first and the second rim sections of the vessel portions.

Although the figures may show a specific order of method steps, the order of the steps may differ from what is depicted. In addition, two or more steps may be performed concurrently or with partial concurrence. Such variation will depend on designer choice. All such variations are within the scope of the disclosure. Additionally, even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A blast-resistant container, comprising:

a first open vessel portion having a first circular rim section having a first outer diameter;

a second open vessel portion having a second circular rim section having a second outer diameter, and a locking arrangement comprising a ring shaped member having a circular inner circumference, the locking arrangement configured for interconnecting the first and the second open vessel portion, wherein an inner diameter of the ring shaped member is greater than the first and the second outer diameter of the first and the second open vessel portion, respectively, wherein:

sets of first axially parallel connection members having a first length are arranged to an outside surface of the first circular rim section, the sets of first axially parallel connection members being spaced apart with a first distance in a circumferential direction;

sets of second axially parallel connection members having a second length are arranged to an outside surface of the second circular rim section, the sets of second axially parallel connection members being spaced apart with a second distance in a circumferential direction;

an inner surface of the ring shaped member comprises first and second axially separated locking sections;

the first locking section comprises spaced apart sets of third axially parallel connection members matching the sets of first axially parallel connection members arranged at the outside surface of the first circular rim; and the second locking section comprises spaced apart sets of fourth axially parallel connection members matching the sets of second axially parallel connection members arranged at the outside surface of the second circular rim.

2. The blast-resistant container according to claim 1, wherein:

the first distance is greater than the second distance, and the first length is greater than the second length.

3. The blast-resistant container according to claim 1, wherein the first outer diameter corresponds to the second outer diameter.

4. The blast-resistant container according to claim 2, wherein the first open vessel portion is locked to the second open vessel portion by rotating the locking arrangement a first predetermined amount in a first direction.

5. The blast-resistant container according to claim 4, wherein the first open vessel portion is locked to the locking arrangement and the second vessel portion is unlocked to the locking arrangement by rotating the locking arrangement a further second amount in the first direction.

6. The blast-resistant container according to claim 5, wherein the first open vessel portion is unlocked to the locking arrangement by rotating the locking arrangement a further third amount in the first direction.

7. The blast-resistant container according to claim 1, wherein a length of the sets of third axially parallel connection members arranged at the first locking section is less than the length of the sets of the first axially parallel connection members.

8. The blast-resistant container according to claim 1, wherein a length of the sets of fourth axially parallel connection members arranged at the second locking section is less than the length of the sets of the second axially parallel connection members.

9. The blast-resistant container according to claim 1, wherein the ring shaped member and the sets of third and fourth axially parallel connection members arranged at the inner surface of the ring shaped member are manufactured from a single piece of material.

10. The blast-resistant container according to claim 1, wherein: (i) the sets of third axially parallel connection members are affixed at the inner surface of the ring shaped member; and (ii) the sets of third axially parallel connection members and the ring shaped member are manufactured from different pieces of material.

11. The blast-resistant container according to claim 10, wherein each of the different pieces of material is a metal material.

12. The blast-resistant container according to claim 11, wherein the affixation of the sets of third axially parallel connection members to the inner surface of the ring shaped member is achieved by welding.

13. The blast-resistant container according to claim 1, wherein the first and the second open vessel portion is constructed from a sheet metal element having a thickness of at least 20 mm.

14. The blast-resistant container according to claim 1, wherein each of the first and the second open vessel portion has a curved inner surface.

15. The blast-resistant container according to claim 1, wherein the container is gas-tight.

* * * * *